US009913016B2

(12) United States Patent
Shin et al.

(10) Patent No.: US 9,913,016 B2
(45) Date of Patent: Mar. 6, 2018

(54) WIRELESS SOUND EQUIPMENT

(71) Applicant: LG ELECTRONICS INC., Seoul (KR)

(72) Inventors: Choonghwan Shin, Seoul (KR); Byunghwa Lee, Seoul (KR); Yonghee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 189 days.

(21) Appl. No.: 14/606,641

(22) Filed: Jan. 27, 2015

(65) Prior Publication Data

US 2015/0382095 A1 Dec. 31, 2015

(30) Foreign Application Priority Data

Jun. 30, 2014 (KR) ..... 10-2014-0080798

(51) Int. Cl.

*H04R 1/10* (2006.01)
*B65H 75/44* (2006.01)
*H04R 5/033* (2006.01)

(52) U.S. Cl.

CPC ..... *H04R 1/1033* (2013.01); *B65H 75/4431* (2013.01); *H04R 5/0335* (2013.01); *H04R 2420/07* (2013.01)

(58) Field of Classification Search

CPC .. H04R 1/1033; H04R 1/1016; H04R 5/0335; H04R 2420/07; B65H 2701/3919; B65H 75/4431

(Continued)

(56) References Cited

U.S. PATENT DOCUMENTS 1,465,281 A * 8/1923 Morrison ..... A45F 5/004 224/671
4,277,654 A * 7/1981 Penning ..... A61B 7/02 381/309

(Continued)

FOREIGN PATENT DOCUMENTS

CN 101384098 3/2009
CN 102317189 1/2012

(Continued)

OTHER PUBLICATIONS

European Patent Office Application Serial No. 14004434.8, Extended Search Report dated Oct. 28, 2015, 4 pages.

(Continued)

*Primary Examiner* — Michael E Gallion
(74) *Attorney, Agent, or Firm* — Lee, Hong, Degerman, Kang & Waimey

(57) ABSTRACT

There is disclosed a wireless sound equipment includes a case; a first holder and a second holder provided in both sides of the case, respectively; a first receiver and a second receiver coupled to and decoupled from the first holder and the second holder, respectively; a first winding device gear rotatably mounted in the case, the first winding device comprising a first gear formed in an outer circumference; a second winding device rotatably mounted in the case, the second winding device comprising a second gear formed in an outer circumference to engage with the first gear; a first audio cable connected between the first receiver and the first winding device to be wound around the circumference of the first winding device; and a second audio cable connected between the second receiver and the second winding device to be wound around the circumference of the second winding device.

17 Claims, 26 Drawing Sheets

(58) Field of Classification Search
USPC ..... 242/385.4
See application file for complete search history.

(56) References Cited

U.S. PATENT DOCUMENTS

| | | | | |
|---|---|---|---|---|
| 6,250,443 | B1 * | 6/2001 | Richter | A61B 6/56 191/12.2 R |
| 8,684,295 | B2 * | 4/2014 | Taketsuna | B65H 75/4431 242/378.4 |
| 8,774,443 | B1 * | 7/2014 | Anderson | B65H 75/4431 242/378.4 |
| 8,811,646 | B1 * | 8/2014 | Romeo | H04R 1/1033 381/370 |
| 9,122,082 | B2 * | 9/2015 | Abreu | G02C 3/003 |
| 9,392,356 | B2 * | 7/2016 | Lee | H04R 1/10 |
| 2005/0220316 | A1 * | 10/2005 | Hsiang | H04B 1/385 381/315 |
| 2008/0143954 | A1 * | 6/2008 | Abreu | G02C 3/003 351/158 |
| 2010/0151922 | A1 | 6/2010 | Zheng | |
| 2011/0284676 | A1 * | 11/2011 | Taketsuna | B65H 75/4431 242/378.4 |
| 2012/0138724 | A1 * | 6/2012 | Chen | B65H 75/4434 242/378.1 |
| 2012/0138725 | A1 * | 6/2012 | Chen | B65H 75/4428 242/378.1 |
| 2012/0153065 | A1 * | 6/2012 | Fischer | B65H 75/4431 242/379 |
| 2012/0210489 | A1 * | 8/2012 | Abreu | G02C 3/003 2/69 |
| 2014/0037122 | A1 | 2/2014 | Lee | |
| 2014/0291431 | A1 * | 10/2014 | Huang | E06B 9/322 242/372 |
| 2015/0034752 | A1 * | 2/2015 | Homar | B65H 75/4431 242/372 |
| 2015/0264474 | A1 * | 9/2015 | Seo | H04R 1/1091 381/74 |

FOREIGN PATENT DOCUMENTS

| | | |
|---|---|---|
| CN | 202998406 | 6/2013 |
| CN | 203225862 | 10/2013 |
| KR | 10-2009-0083159 | 8/2009 |
| KR | 10-2012-0017918 | 2/2012 |
| KR | 10-1289244 | 7/2013 |
| KR | 10-1321008 | 10/2013 |
| KR | 10-2014-0064590 | 5/2014 |
| WO | 2013/126020 | 8/2013 |

OTHER PUBLICATIONS

The State Intellectual Property Office of the Peoples Republic of China Application Serial No. 201510178198.7, Office Action dated Dec. 4, 2017, 13 pages.

* cited by examiner

WIRELESS SOUND EQUIPMENT

Pursuant to 35 U.S.C. § 119(a), this application claims the benefit of earlier filing date and right of priority to Korean Application No. 10-2014-0080798, filed on Jun. 30, 2014, the contents of which are hereby incorporated by reference herein in their entirety.

BACKGROUND OF THE DISCLOSURE

Field of the Disclosure

Embodiments of the present disclosure relates to an earset of which a wire for connecting a case and a receiver with each other may be loaded in the case when not used and retractable from the case when used.

Discussion of the Related Art

An earset means a sound device having an earphone and a microphone coupled thereto to receive an audio signal from a terminal and to transfer the sound information collected through the microphone to the terminal. A conventional earset has a terminal connected to an ear-jack of a terminal to receive an audio signal, using a wire communication method. In an aspect of mobility and usage, demand for wireless communication type earsets is increasing recently.

Development of wireless sound equipment having a design considering hand-held is in progress. Examples of such wireless sound equipment include a band type headphone wearable on a user's head, an ear-wearable type and an ear-insertable type.

In recent, there is increasing demand for earsets having a case put on a user's neck to ease the user's hand carry, even when a receiver is not put on the ears.

In such an earset having a conventional case, a wire connected from the case to a receiver is exposed outside. Accordingly, in maintenance, the wire happens to be twisted or tangled with other stuffs disadvantageously.

SUMMARY OF THE DISCLOSURE

An object of the present disclosure is to provide a wireless sound equipment of which a wire connecting a case with a receiver may be held in the case when not used and retracted from the case when used.

To achieve these objects and other advantages and in accordance with the purpose of the disclosure, as embodied and broadly described herein, wireless sound equipment includes a case comprising a first housing and a second housing for forming an exterior appearance; a first holder and a second holder provided in both sides of the case, respectively; a first receiver and a second receiver coupled to and decoupled from the first holder and the second holder, respectively; a first winding device gear rotatably mounted in the case, the first winding device comprising a first gear formed in an outer circumference; a second winding device rotatably mounted in the case, the second winding device comprising a second gear formed in an outer circumference to engage with the first gear; a first audio cable connected between the first receiver and the first winding device to be wound around the circumference of the first winding device; and a second audio cable connected between the second receiver and the second winding device to be wound around the circumference of the second winding device.

The wireless sound equipment may further include a stopping projection formed in an outer surface of at least one of the first and second winding devices, the stopping projection comprising a first inclined surface and a second inclined surface formed in asymmetry; and a stopper coupled to the stopping projection to restrict the rotation of the first and second winding devices.

The first inclined surface may be gentle and the second inclined surface may be steep, and the stopper may include a flexible material transformed based on the first winding device and variation of the height of the first inclined surface in a rotational direction of the first winding device, and the stopper may be coupled to the stopping projection to restrict the rotation of the first and second winding devices, when located on the second inclined surface.

The wireless sound equipment may further include a restitution switch for decoupling the stopper from the stopping projection to allow the rotation of the first and second winding devices.

Each of the first and second winding devices include a base plate coupled to the case; a shaft projected from a top surface of the base plate; a cylindrical rotation housing disposed on a top surface of the base plate; a gear projected from an outer surface of the rotation housing; and a helical spring comprising one end coupled to the shaft and the other end spirally wound around the shaft and coupled to the rotation housing.

A helical spring of the first winding device and a helical spring of the second winding device may be wound in the reverse direction.

The wireless sound equipment may further include a horizontal motion unit for adjusting a distance between the first and second winding devices by moving at least one of the first and second winding devices, wherein when the distance between the first and second winding devices is increased, the first and second gear engaging with each other is separated from each other.

The horizontal motion unit may include a slide slit fixed to the case and extended in one direction; and a slide bar projected from a lower surface of the first or second winding device and movable in a state of being inserted in the slide slit.

The horizontal motion unit may further include a first fixing projection formed in the slide slit; and a second fixing projection formed in the slide bar, and the first fixing projection and the second fixing projection may be overlapped with each other in a thickness direction of the slide slit while the winding device is moving, and the first fixing projection and the second fixing projection may be overlapped with each other in a longitudinal direction when the motion of the winding device is completed.

The length of the first fixing projection may be corresponding to a moving distance of the horizontal motion unit.

The wireless sound equipment may further include a slide button exposed outside the case to drive the horizontal motion unit.

The wireless sound equipment may further include a stopping projection comprising a first inclined surface and a second inclined surface formed in outer surfaces of the first and second winding devices in asymmetry, respectively; and a stopper projected from an inside of the cover case and coupled to the stopping projection to restrict the rotation of the first and second winding devices, wherein the stopper may include a first stopper coupled to at least one of the stopping projection of the first winding device and the stopping projection of the second winding device, in a state where the first gear and the second gear engage with each other; and a second stopper coupled to each stopping projection of the first and second winding devices, in a state where the first gear and the second gear are separated from each other.

The stopper may further include a leaf spring which is folded.

The stopper may be projected from an inside of the cover case provided in each outer circumference of the first and second winding devices, and the cover case may include a fixing case fixed to the case; and a moving case coupled to the stopper to relatively slide with respect to the fixing case and to adjust a distance between the stopper and the stopping projection.

The wireless sound equipment may further include a restitution switch having a force applied by a user in a direction where the stopper is spaced apart from the stopping projection.

The wireless sound equipment may further include a flexible material disposed between the moving case and the fixing case to restitute the moving case to an original position after the moving case slidingly moves.

The case may include a plurality of frames, the wireless sound equipment further comprising a hinge unit for adjusting an angle between the plurality of the frames.

The wireless sound equipment may further include at least one of a speaker and a microphone coupled to the case.

The case may be a U-shaped band and one end of the case may be transformed by the user and the end of the case may be fixed in a state of being transformed.

The wireless sound equipment may further include a wire mounted in the case, wherein the first audio cable and the second audio cable are wound around the wire.

The first holder and the second holder may be located under the user's ear, when the case is worn on the user's neck.

The first holder and the first receiver and the second holder and the second receiver may be coupled to and decoupled from each other by a magnetic force Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
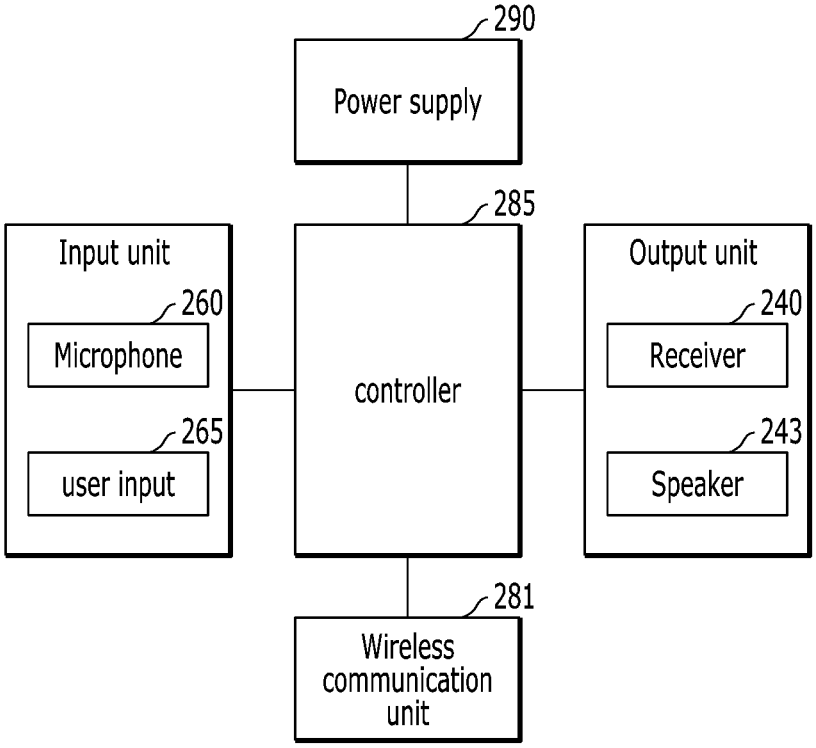
FIG. 1 is a block diagram illustrating a structure of wireless sound equipment in accordance with the present disclosure.

FIG. 1 is a block diagram illustrating a structure of wireless sound equipment in accordance with the present disclosure. The wireless sound equipment 200 in accordance with the present disclosure includes a controller 285, a wireless communication unit 281, a receiver 240, a speaker 243, a microphone 260, a user input unit 265 and a power supply unit 290.

The wireless communication unit 281 is a device for receiving an audio signal from an external terminal or an external server or to transfer a sound or signal input via the wireless sound equipment 200 to an external terminal or to an external server wirelessly. A typical example of the wireless communication unit 281 may be Bluetooth.

Bluetooth is a typical example of near field communication standard for exchanging information by connecting hand-held devices with each other. Examples of hand-held devices include a mobile terminal, a notebook, an earphone and a headphone. Such Bluetooth is used when low power wireless connection is necessary in a short range of 10~20 meters. Bluetooth uses 2400~2483.5 MHz which is in ISM (Industrial Scientific and Medical) frequency band.

To stop the interference of other systems using higher and lower frequencies than ISM frequency band, Bluetooth uses 79 channels of 2402~2480 MHz, except a band from 2 MHz higher than 2400 MHz to 3.5 MHz lower than 2483.5 MHz. ISM is a frequency band assigned for industrial, scientific and medical usage. As it does not need permission to use electric waves, ISM is used a lot in a personal wireless device for emitting low power electric waves. Amateur radio, wireless LAN and Bluetooth use this ISM band.

The receiver 240 and the speaker 243 are devices for outputting sounds. The receiver 240 is a device for transferring sound when put near a user's ear and the speaker 243 is a device for transferring sound to the user in a state of being held. The sound output from the receiver 240 is smaller than the sound output from the speaker 243.

The microphone 260 processes an external sound signal into electric sound data. The processed sound data is transferred to an external terminal or an external server via the wireless communication unit 281. Diverse noise removal algorithms may be realized in the microphone 260 to remove the noise generated in the process of receiving an external input sound signal.

The user input unit 265 may be an input unit used when the user remove the wireless sound equipment 200 intentionally, and it may include a button for a call or volume control or a receiver holding key for inserting the receiver 240 in the case 210.

The wireless sound equipment 200 may further include a sensing unit for sensing a state of the equipment and a circumstantial situation. In addition, the wireless sound equipment 200 may include an illuminance sensor for sensing peripheral illumination, a touch sensor for sensing a touch input, a gyro-sensor for sensing a gradient and a location of the wireless sound equipment 200 and a sensor for sensing presence of the receiver in a receiver holder.

Figure 2:
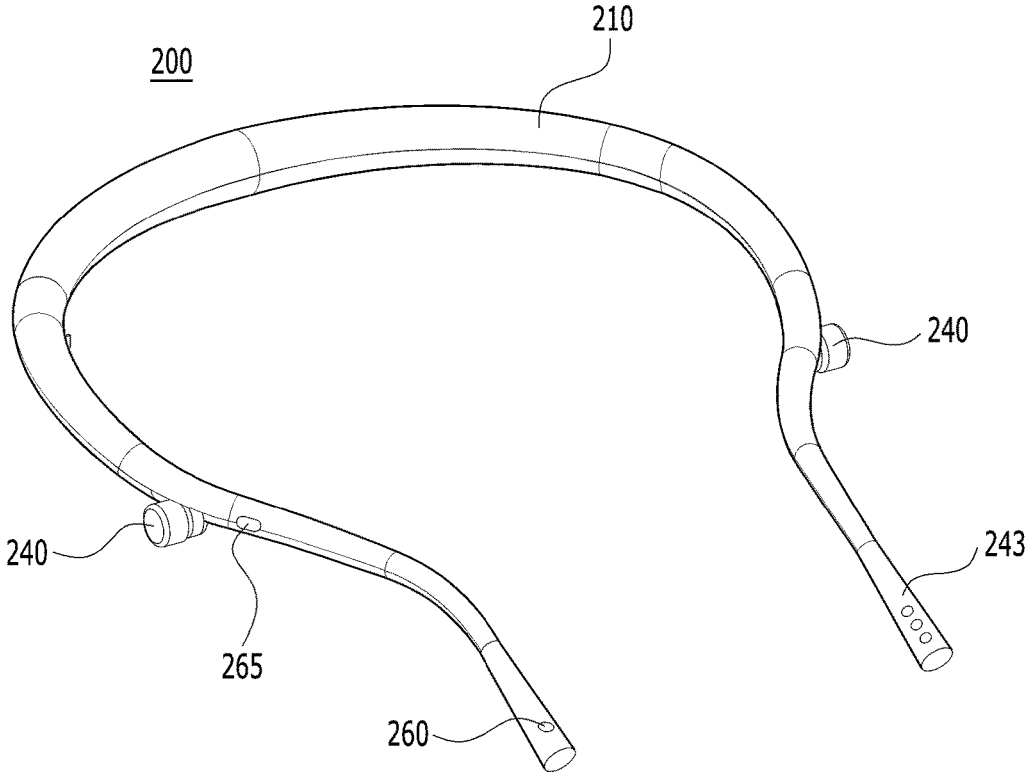
FIG. 2 is a perspective diagram illustrating wireless sound equipment in accordance with one embodiment of the present disclosure.
Figure 3:
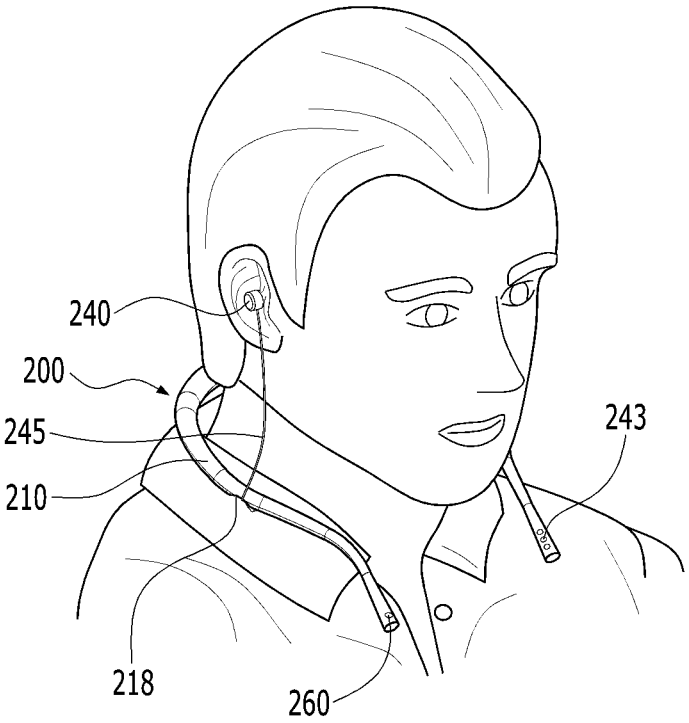
FIG. 3 is a diagram illustrating wireless sound equipment in accordance with one embodiment of the present disclosure, which is worn by a user.

FIG. 2 is a perspective diagram illustrating wireless sound equipment in accordance with one embodiment of the present disclosure. FIG. 3 is a diagram illustrating wireless sound equipment in accordance with one embodiment of the present disclosure, which is worn by a user.

The wireless sound equipment 200 in accordance with the present disclosure may include a case 210 in which a wireless communication device for communicating with an external device and a controller (285, a main board) for controlling the wireless sound equipment 200 are mounted. The case 210 may be formed in a curved band shape curved like "C" to be put on the user's neck. The case 210 may be wearable on a back side of the user's neck. To ease the wearing, the case 210 may be formed of a flexible material and it may be easily curved or bent and restituted right away.

The receiver 240 is the device for converting an audio signal into sound. The receiver 240 may be connected to the base 210 via an audio cable 245 to be supplied the audio signal and electric power. Unless the user listens to the music, in other words, unless the wireless sound equipment 200 is used, the receiver shown in FIG. 2 is coupled to a holder 218 provided in a right and left portions of the case 210. In contrast, when the user listens to the music or makes a call, the receiver 240 shown in FIG. 3 is demounted from the holder 218 to be insertedly put on the user's ear.

An end of the audio cable 245 is provided in the case 210 and the other end is connected to the receiver 240 located outside the case 210. For that, a hole is formed in the holder 218 to pass the audio cable 245 there through.

The audio cable 245 for connecting the receiver 240 and the case 210 to each other is inserted in the case 210 as shown in FIG. 2, when the receiver 240 is held in the holder 218. When the user takes it out from the case 210, the audio cable 245 is drawn from the case to be put on the ear as shown in FIG. 2. In other words, the wireless sound equipment 200 in accordance with the present disclosure can be held in the case 210, without exposing the audio cable 245 outside.

The holder 218 provided in each of the right and left portions of the case 210 may be recessed in a corresponding shape to a shape of the receiver, such that the receiver 240 can be coupled to the holder. A magnet may be provided in an inside of either of the holder 218 and the receiver and a magnetic or metallic material is provided in the other.

The holders 218 may be provided right and left ends of the case 210, respectively. Alternatively, the holder 218 may be arranged to be located under the user's ear when the user wears the case 210 on the neck to insertedly put the receiver 240 decoupled from the holder 218 on the user's ear as shown in FIG. 3. When the holder 218 is arranged near the user's ear, the drawn audio cable 245 is short and a disadvantage of cumbersome wire can be overcome.

The user input unit 265 for inputting a user's command in a physical type (a dome button, a slide button and so on) or a touch type may be further provided in the case 210. In the drawing, one user input unit 265 is shown and a plurality of user input units 265 may be provided based on functions.

A physical key or a touch key may be provided to turn off the power, to connect a received call or to pause or replay the playing music.

Figure 4:
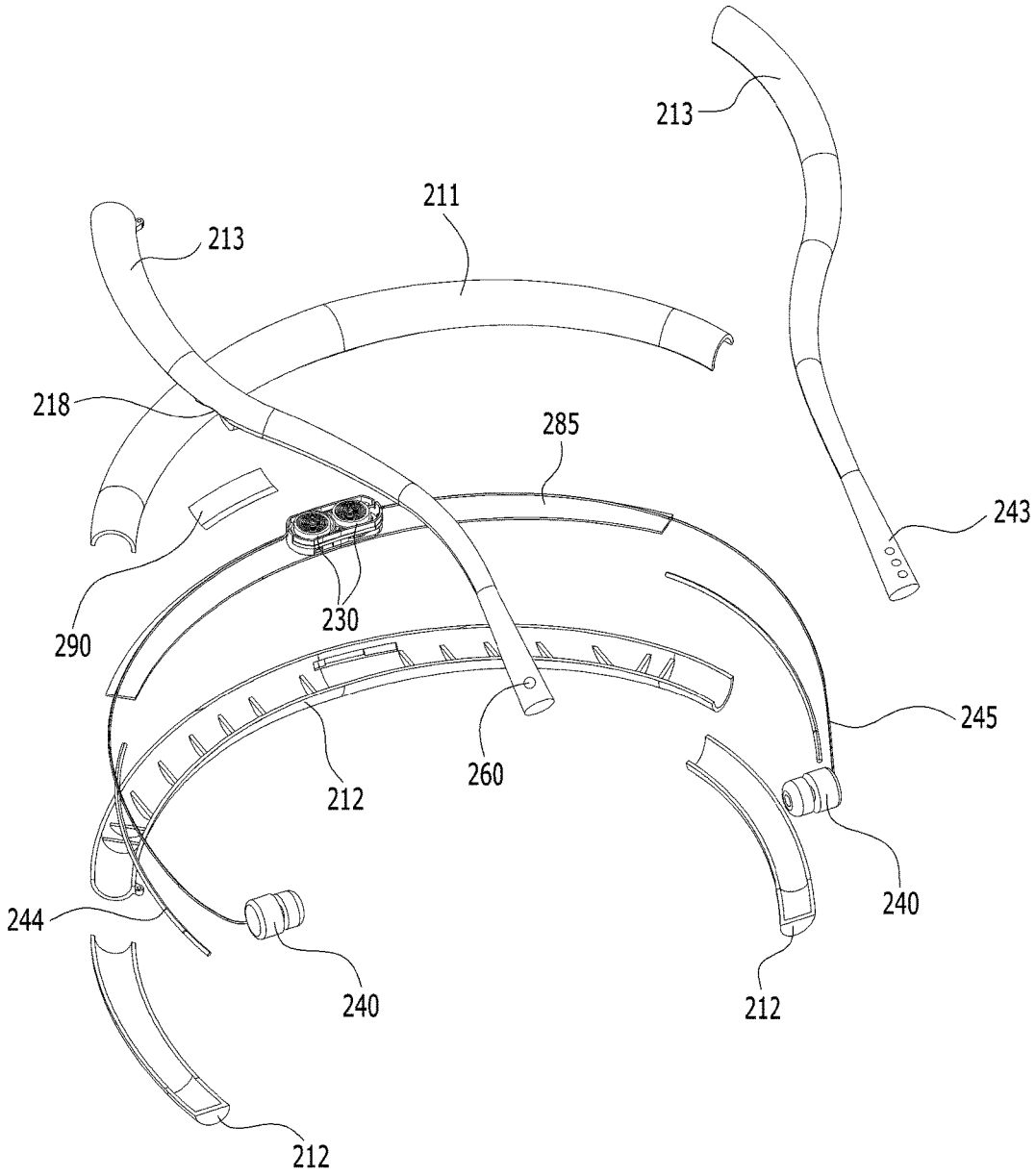
FIG. 4 is an exploded perspective diagram of wireless sound equipment in accordance with one embodiment of the present disclosure.

FIG. 4 is an exploded perspective diagram of the case 210 of the wireless sound equipment 200 in accordance with one embodiment of the present disclosure. The case 210 is formed of a first housing 211 and a second housing 212 coupled to each other to define a predetermined space in the case 210. As shown in FIG. 4, each of the first housing 211 and the second housing 212 may be divided into a plurality of pieces.

In the case 210 may be mounted in a main board 285 for controlling the wireless sound equipment 200, a wireless communication unit (not shown) for transferring and receiving a signal to and from an external terminal and a power supply unit 290 for supplying the power to each of elements provided in the wireless sound equipment 200. In addition, a pair of winding devices 230 for holding the audio cable 245 may be provided in the case 210.

The pair of the winding devices 230 may be mounted in the internal space of the case 210 to rotate on a center thereof on its axis. The pair of the winding devices 230 may be arranged in a center portion of the case 210 as shown in FIG. 4, adjacent to each other. When holding the receiver 240 in the holder 218, the audio cable 245 is winding around the winding device 230. When the audio cable 245 is drawn from the case after the receiver 240 is decoupled from the holder 218, the audio cable 245 is unwound from the winding device 230 and exposed outside the case 210.

Figure 5:
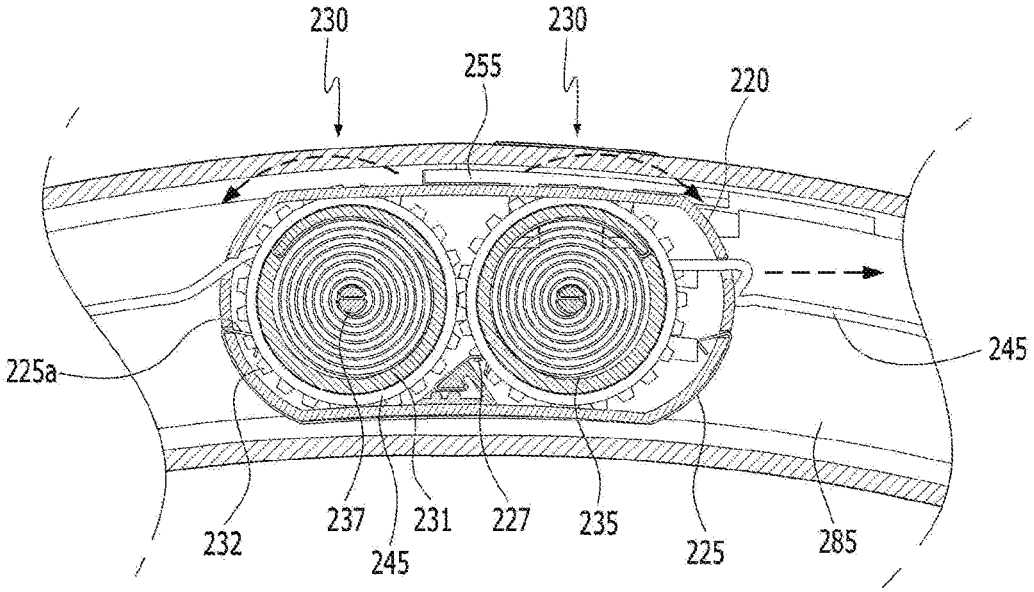
FIG. 5 is a plane view illustrating a winding device provided in a wireless sound equipment in accordance with one embodiment of the present disclosure.
Figure 6:
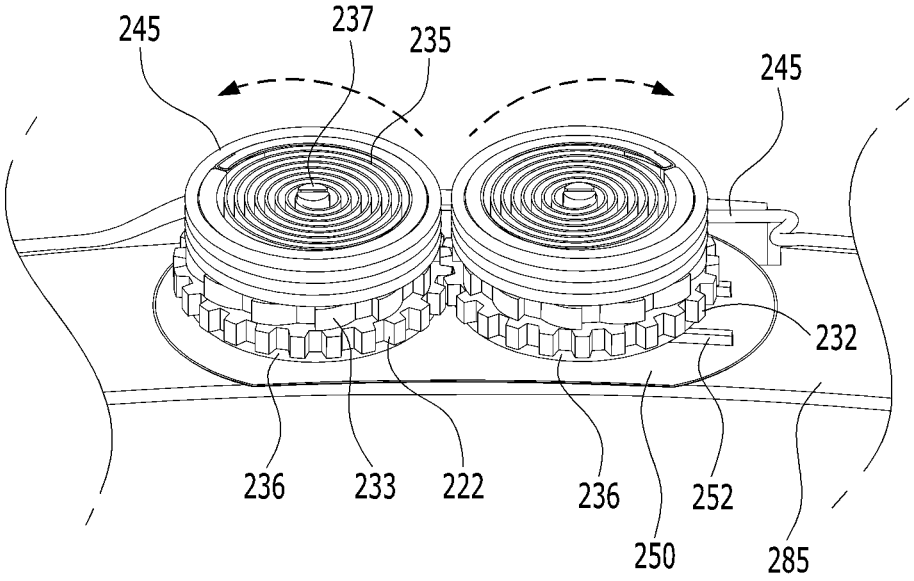
FIG. 6 is a perspective diagram illustrating a winding device provided in a wireless sound equipment in accordance with one embodiment of the present disclosure.

FIG. 5 is a plane view illustrating the winding device 230 provided in the wireless sound equipment 200 in accordance with one embodiment of the present disclosure. FIG. 6 is a perspective diagram illustrating the winding device 230 provided in the wireless sound equipment 200 in accordance with one embodiment of the present disclosure.

As shown in FIGS. 5 and 6, each of the winding devices 230 has a gear 232 configured of a plurality of projections. Gears 232 of the pair of the winding devices 230 may engage with each other. When one of the winding devices 230 rotates, the other one rotates together. When the user pulls the receiver 240 to draw one portion of the audio cable 245, the other portion of the audio cable 245 is unwound from the winding devices 230 and drawn outside the case 210.

While rotating in the reverse direction, the audio cable 245 is winding around the pair of the winding devices 230 in the reverse directions, such that the audio cable 245 is unwound from the winding devices 230 simultaneously or winding around the winding devices 230 simultaneously. When the user pulls the receiver 240 in a right direction shown in the drawing to draw the audio cable 245, a right winding device 230 rotates in a clockwise direction and a left winding device 230 rotates in a counter-clockwise direction.

Figure 7:
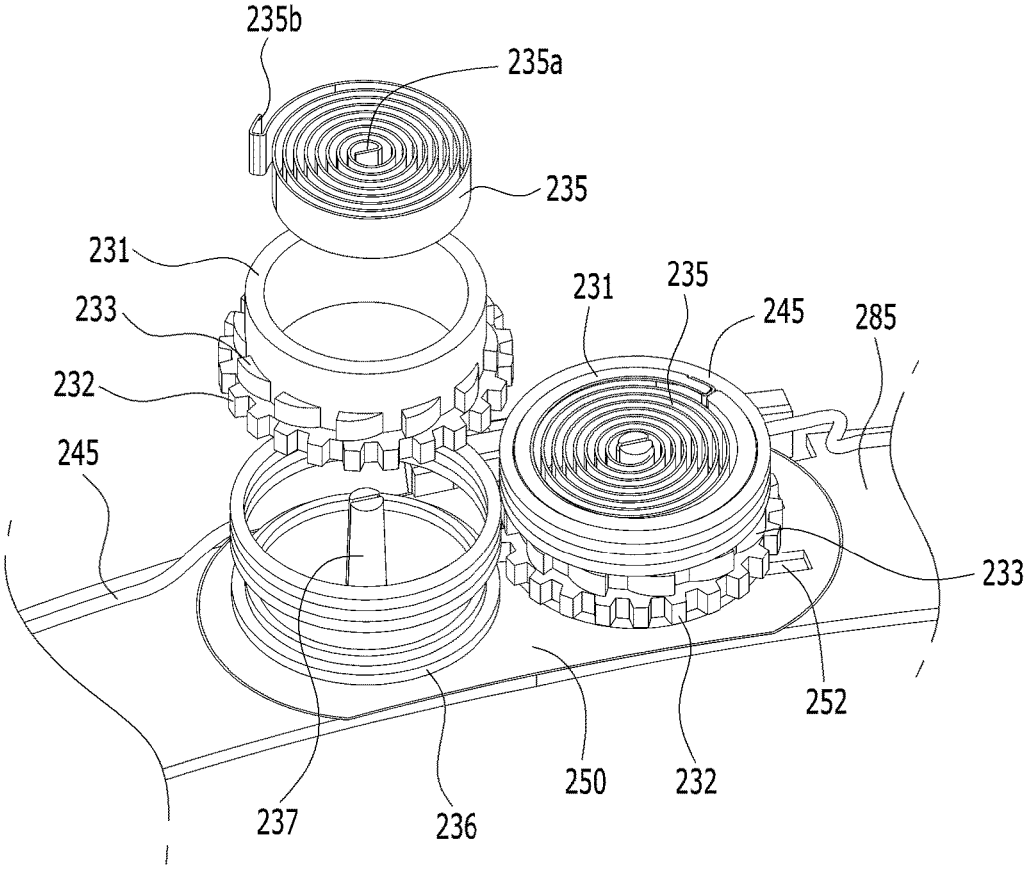
FIG. 7 is an exploded perspective diagram illustrating a winding device provided in wireless sound equipment in accordance with one embodiment of the present disclosure.

FIG. 7 is an exploded perspective diagram illustrating a winding device 230 provided in wireless sound equipment 200 in accordance with one embodiment of the present disclosure. The winding device 230 includes a base plate 236, a shaft 237, a rotation housing 231, a gear 232 and a helical spring 235.

The base plate 236 is coupled to the case 210 and not rotates but secured to the case 210, when the winding devices 230 are rotating. The other materials of the winding devices 230 rotate on the shaft 237 projected from a center of the base plate 236.

The housing 231 is a circular-shaped material and it is disposed on a top surface of the base plate 236. An unevenness having a corresponding shape to a shape of the rotation housing 231 is formed in the base plate 236, such that the rotation housing 231 can be disposed on the top surface of the base plate 236 stably. In the embodiment shown in FIG. 7, unevenness is formed to be coupled to an inner cylindrical portion of the rotation housing 231.

While it is winding around an outer portion of the rotation housing 231, the audio cable 245 is held in the case 210. One end of the audio cable 245 is fixed to the rotation housing 230. When the user is pulling the audio cable 245, the rotation housing 231 is rotating in a direction in which the audio cable 245 is winding. When the rotation housing 231 is rotated in the reverse direction, the audio cable 245 is winding around the rotation housing 231.

The helical spring is a material having a metallic tape spirally wound there around and it has a force of restitution in an arc from a center. The helical spring 235 provided in a left portion of the drawing is wound from a center in a counter-clockwise direction and it has a force of restitution for restoring a counter-clockwise direction force into a clockwise direction force.

One end of the helical spring 235 is coupled to the shaft 237 to be wound on the shaft 237 spirally and the other end of the helical spring is coupled to the rotation housing 231. When the rotation housing 231 is rotating in the direction in which the helical spring 235 is wound, a force of restitution in the reverse direction is generated.

Accordingly, when the force for pulling the audio cable 245 is removed, the audio cable 245 is re-wound around the rotation housing 231 by the restitution of the helical spring 235.

The gear 232 is formed in an outer surface of the rotation housing 231 and the pair of the winding devices 230 may engage with each other through the gears 232. When one of the rotation housings 231 is rotated by the engaging gears 232, the other one is rotated at the same time. At this time, rotational directions are in reverse as shown in FIGS. 5 and 6.

A stopping projection 233 formed in the outer surface of the rotation housing 231, with a different height from the height of the gear 232. The stopping projection 233 engages with stoppers 225*a*, 225*b* and 227 shown in FIGS. 8 through 10 and restricts the rotation generated by the restitution of the helical spring 235. The positions of the gear 232, the stopping projection 233 and the audio cable 245 may be clearly distinguished in a layered structure as shown in FIGS. 6 and 7.

FIGS. 8 through 11 are diagrams illustrating the stoppers 225*a*, 225*b* and 227 of the wireless sound equipment 200 in accordance with one embodiment of the present disclosure. The stopping projection 233 stops the rotation housing 231 from rotating, resisting the restitution of the helical spring 235. The stopping projection 233 has two inclined surfaces to be projected in a triangle shape. An inclined surface (a first inclined surface 233*a*) as a gently inclined surface formed in a direction of the rotation housing 231 rotated as the audio cable 245 is unwound. Accordingly, when the user pulls the audio cable 245, the housing 231 may rotate easily.

However, the other inclined surface (a second inclined surface 233*b*) formed in a direction of the rotation housing 231 rotated by the restitution of the helical spring 235 may be inclined steeply or obtusely, such that the stoppers 225*a*, 225*b* and 227 are stopped by the stopping projection 233 to restrict the rotation housing 231 from being rotated by the restitution of the helical spring 235.

The rotation housing 231 can be easily rotated in the direction in which the audio cable 245 is unwounded by asymmetrically inclined surfaces 233*a* and 233*b* of the stopping projection 233 and it is stopped from being rotated in the direction in which the audio cable 245 is wound.

To re-hold the drawn audio cable 245 in the case 210, the shape or location of the stopper 225*a*, 225*b* and 227 is changed to unlock the stopped state of the stoppers 225*a*, 225*b* and 227 by the stopping projection 233 and then the rotation housing 231 may be rotated in the direction in which the audio cable 245 is wound by the helical spring 235.

When the stoppers 225*a*, 225*b* and 227 are located in the first inclined surface 233*a*, shapes or locations of the stoppers 225*a*, 225*b* and 227 are changed based on variation of the heights of the first inclined surface 233*a*, only to allow the rotation of the rotation housing 231. To change the shape or location of the stoppers 225*a*, 225*b* and 227 based on the variation of heights of the first inclined surface, the stoppers 225*a*, 225*b* and 227 may include a flexible material.

Figure 8:
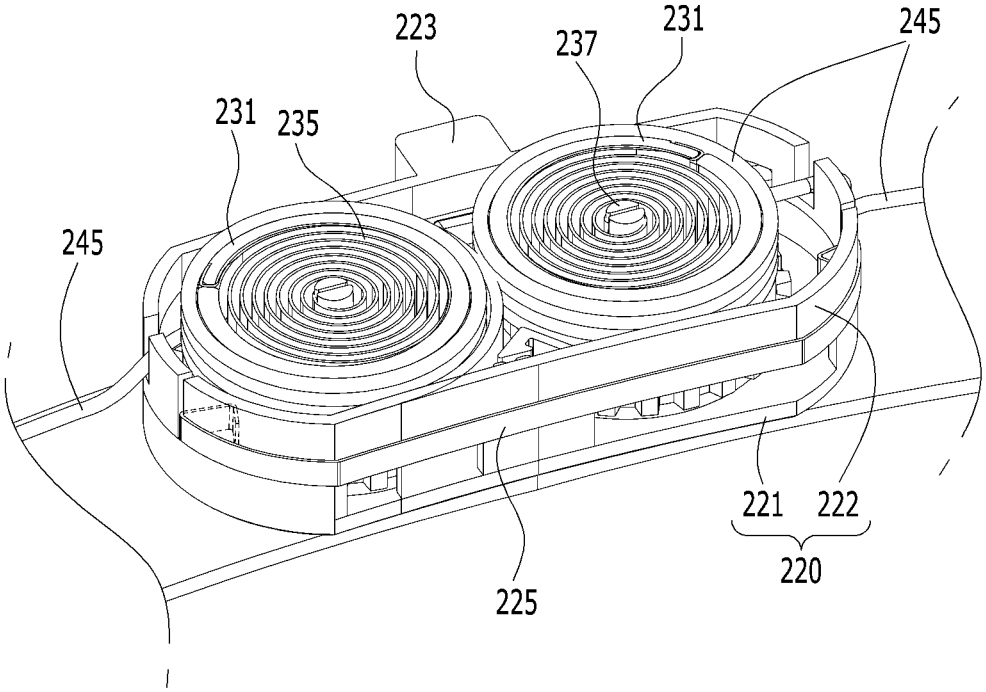
FIGS. 8 through 11 are perspective diagrams illustrating a stopper provided in wireless sound equipment in accordance with one embodiment of the present disclosure.

As shown in FIG. 8, the stoppers 225*a*, 225*b* and 227 may be realized, using a leaf spring. The stoppers 225*a*, 225*b* and 227 are coupled to a cover case 220 surrounding an outer surface of each winding device 230 and the stoppers 225*a*, 225*b* and 227 may be arranged adjacent to the stopping projection 233.

Figure 9:
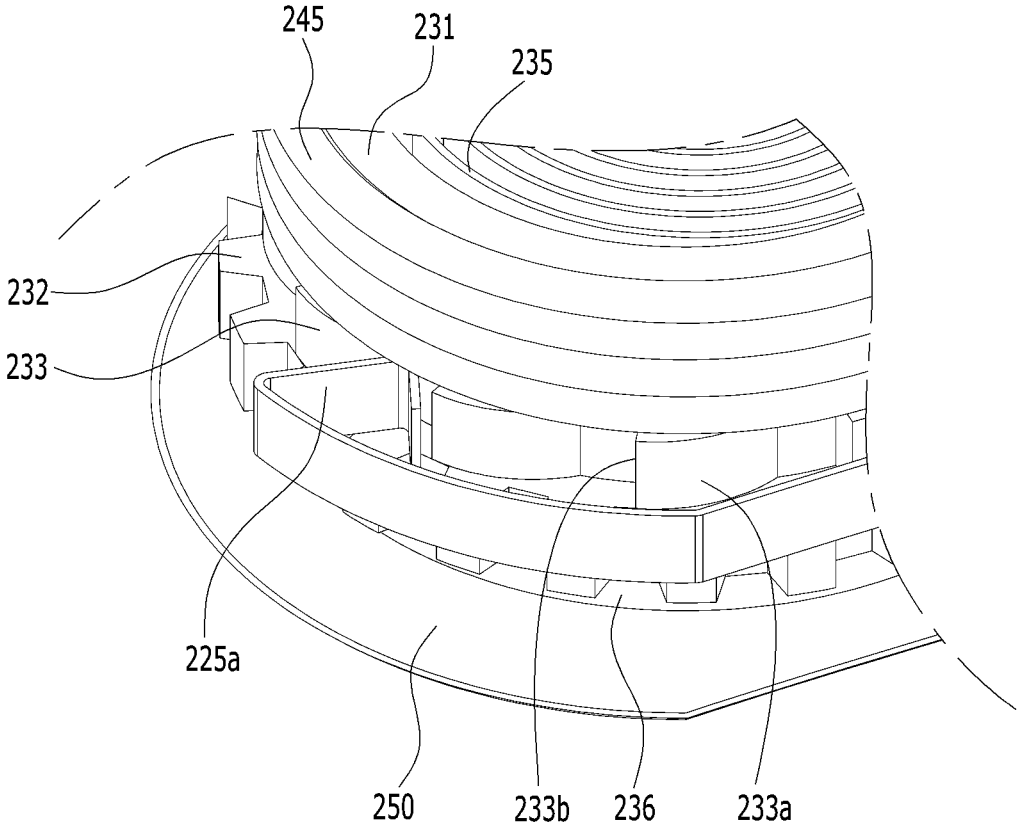
Figure 10:
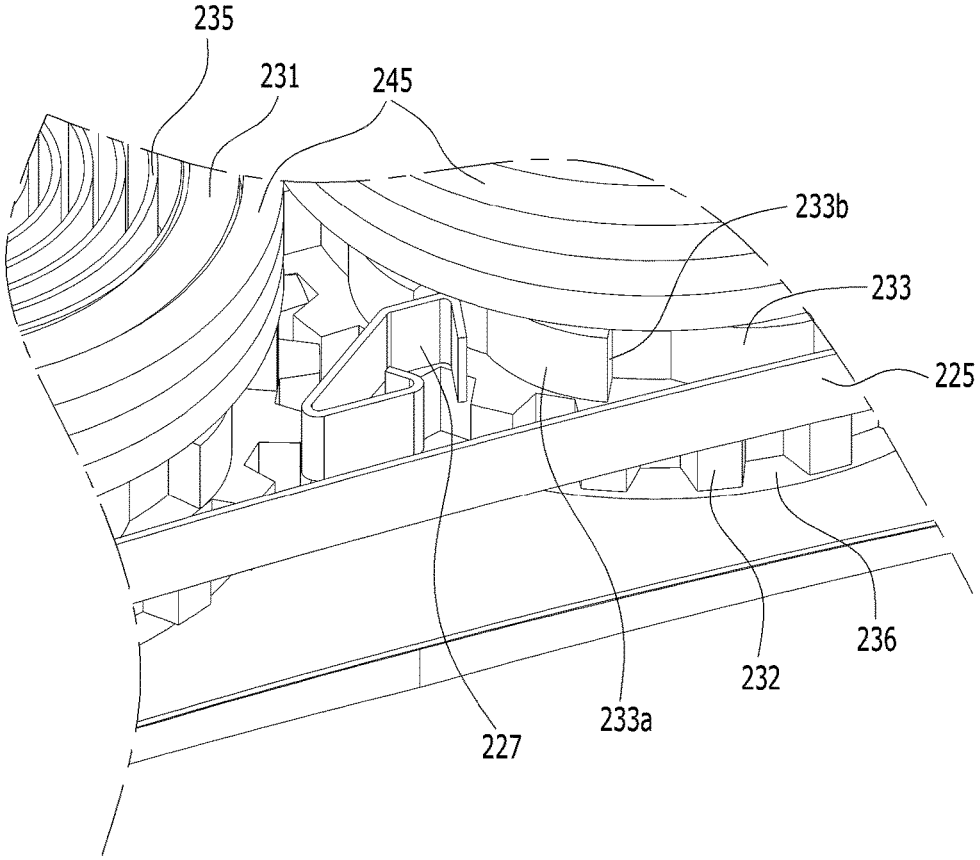
Figure 11:
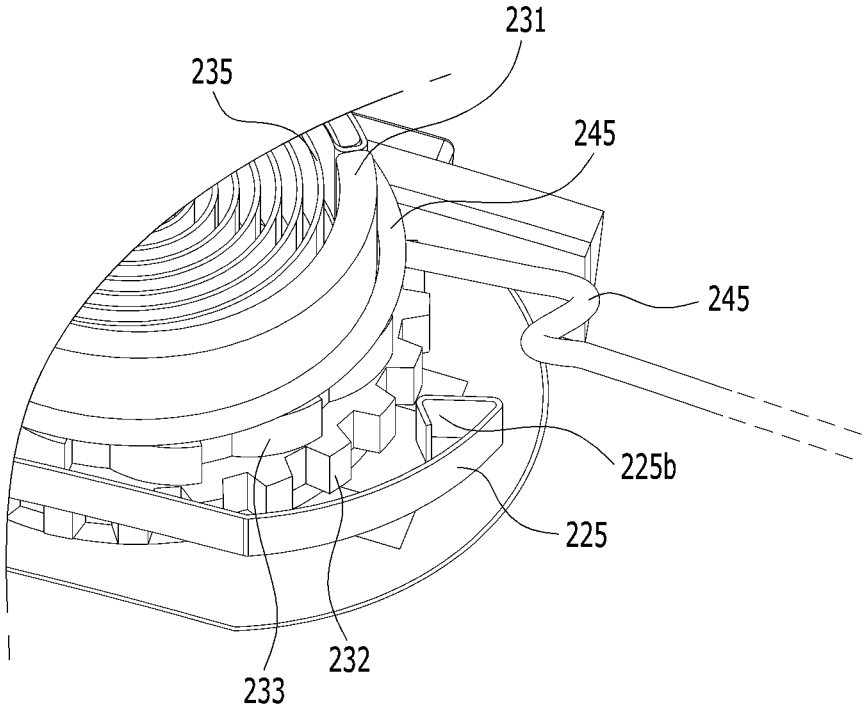

Using one longitudinal leaf spring 225, each of the stoppers 225*a*, 225*b* and 227 may be realized in both sides as shown in FIGS. 9 through 11. A predetermined portion of the leaf spring may be coupled to the cover case 220 and the other portion of the leaf spring may be functioned as the stopper 227.

The leaf spring has elasticity and the shape of the leaf spring is changed based on variation of the height of the first inclined surface 233*aa* on the first inclined surface 233*a*, to pass on the first inclined surface 23*a*. When it reaches the second inclined surface 233*b*, the leaf spring restricts the rotation of the rotation housing 231.

When a force is applied to the stoppers 225*a*, 225*b* and 227 to space them apart from the stopping projection 233 of the winding device 230, the stoppers 225*a*, 225*b* and 227 is separated from the stopping projection 233 and the rotation housing 231 may be rotated by the restitution of the helical spring 235.

The cover case 220 shown in FIG. 8 may include a fixing case 221 fixed to the case 210, a moving case 222 coupled to the fixing case 221 to be movable a preset distance. A lower portion of the cover case 220 is the fixing case 221 and an upper portion of the cover case 220 is the moving case 222. Or, only a middle portion of the cover case 220 is partitioned off as the moving case 222.

Figure 12:
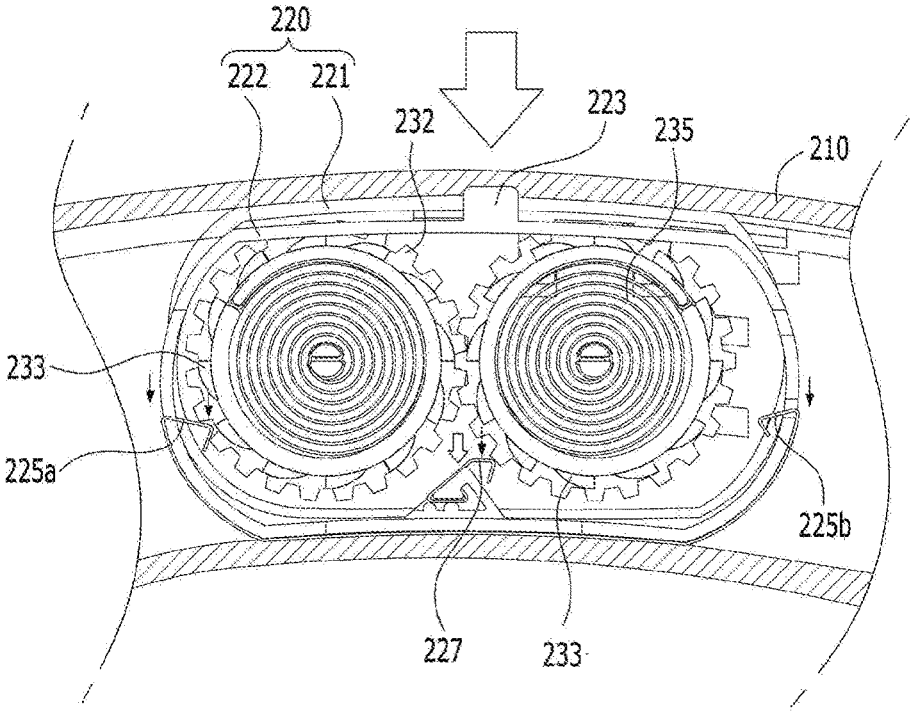
FIGS. 12 through 15 are perspective diagrams illustrating a winding device and a cover case provided in wireless sound equipment in accordance with one embodiment of the present disclosure.
Figure 13:
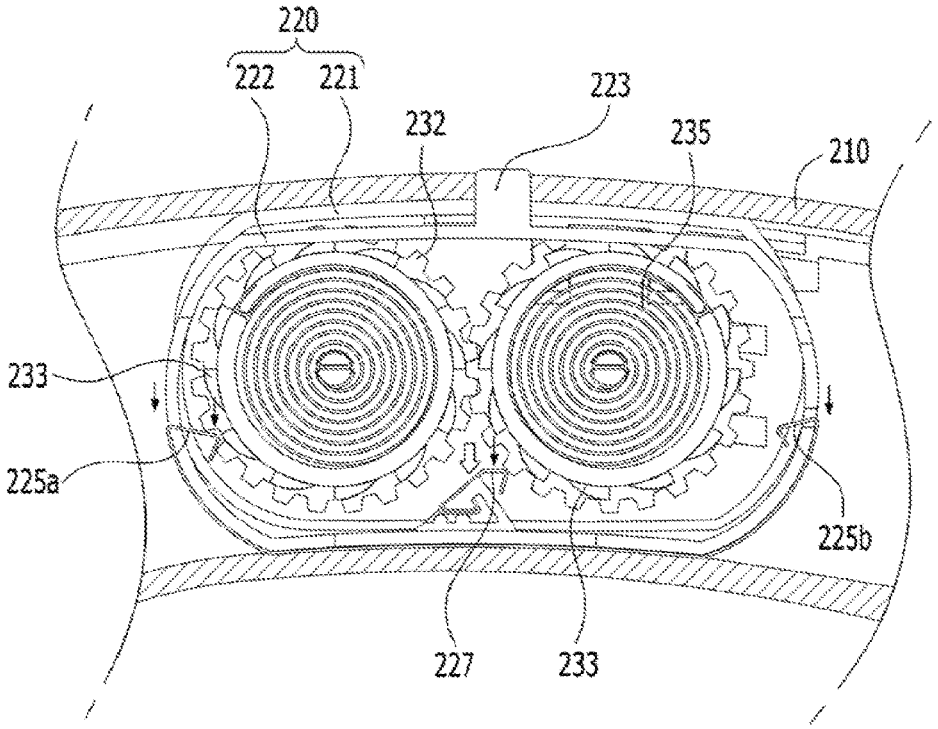
Figure 14:
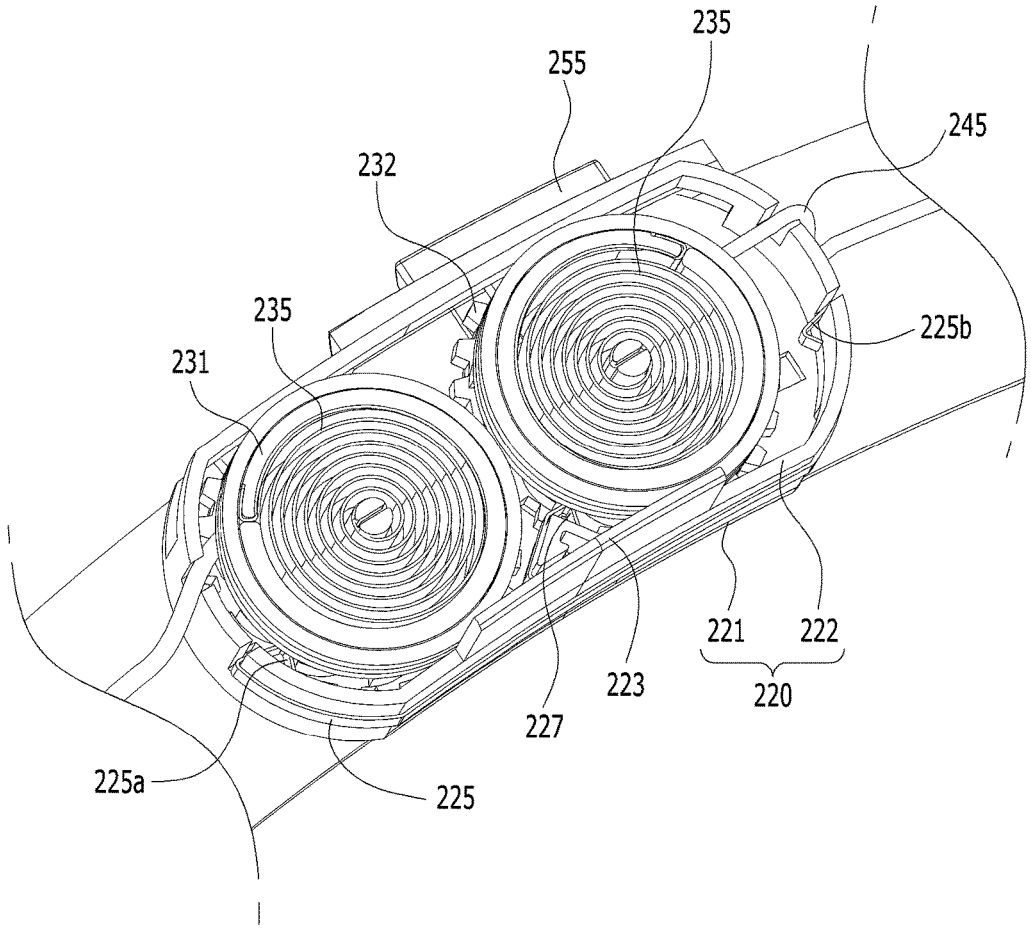

The moving case 222 can slidingly move from the fixing case 221 in a predetermined direction and it includes a restitution switch 223 projected from the moving case 222 to transfer a force to the moving case 222. The restitution switch 223 shown in FIG. 12 may be arranged in the case 210. When pressurizing the case 210, the moving case 222 may move. Alternatively, the moving case 222 is projected from the case 210 to be exposed outside as shown in FIG. 13.

The stoppers 225*a*, 225*b* and 227 mentioned above are coupled to the moving case 222. When a force is applied to the moving case 222 as shown in FIGS. 12 and 13, the moving case 222 may move from the fixing case 21 in a predetermined direction and the locations of the stoppers 225*a*, 225*b* and 227 may be moved. When the stoppers 225*a*, 225*b* and 227 are spaced apart from the stopping projection 233, the rotation housing 231 may be rotated.

A flexible material may be provided between the moving case 222 and the fixing case 221. When the force applied to the moving case 222 is removed, the moving case is restituted to an original position and coupled to the stoppers 225*a*, 225*b* and 227, to stop the rotation housing 231 from rotating in the direction where the audio cable is wound.

In another embodiment of the moving case 222, the moving case 222 and the fixing case 221 are not divided vertically and a predetermined upper portion may be divided as the moving case 222. In other words, the portion coupled to the leaf spring of the stopper 225*a*, 225*b* and 227 may be divided as the moving case 222.

Figure 15:
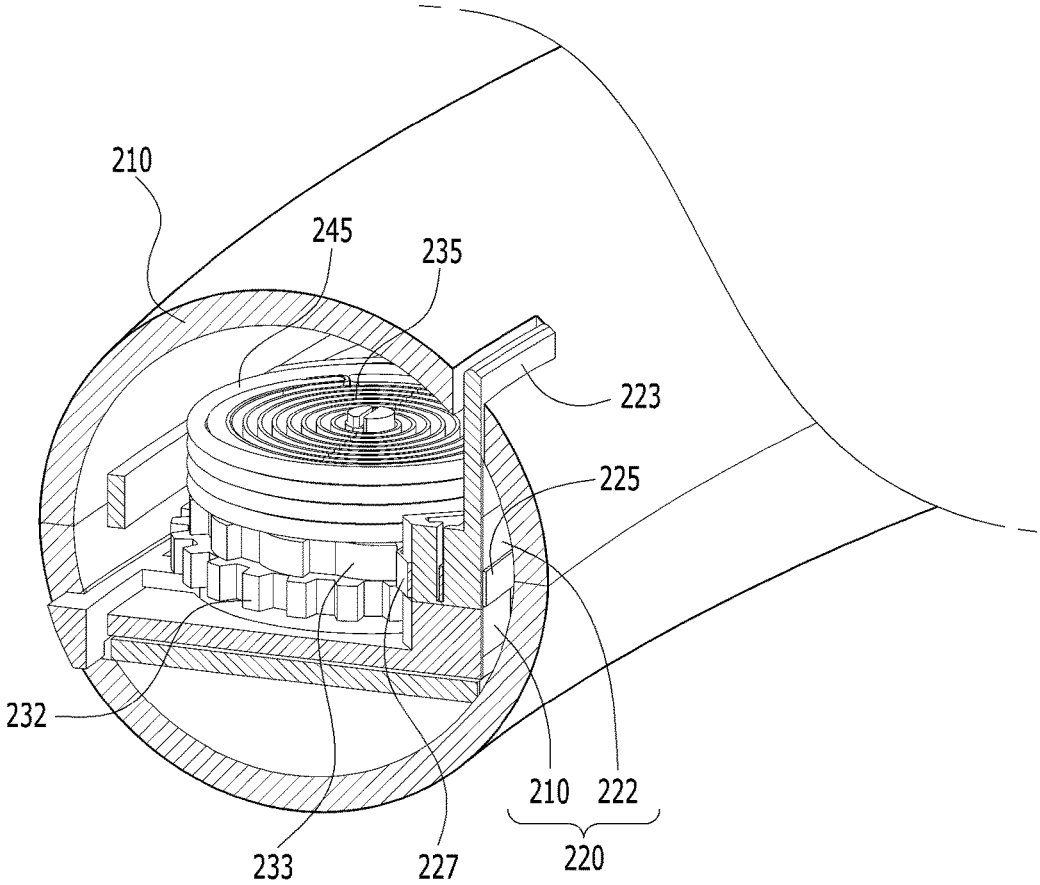

Different from the restitution switch 223 projected in parallel to the moving direction of the stopper 225*a*, 225*b* and 227 mentioned above, the restitution switch 223 shown in FIG. 15 may be projected in a vertical direction with respect to the moving direction of the stoppers to be exposed outside the case 210.

When the restitution switch 223 projected outside the case 210 is pushed in a direction where the stoppers 225*a*, 225*b* and 227 are distant from the stopping projection, the moving case 222 may slidingly move and the rotation housing stopped from being rotated by the stoppers may rotate.

Figure 16:
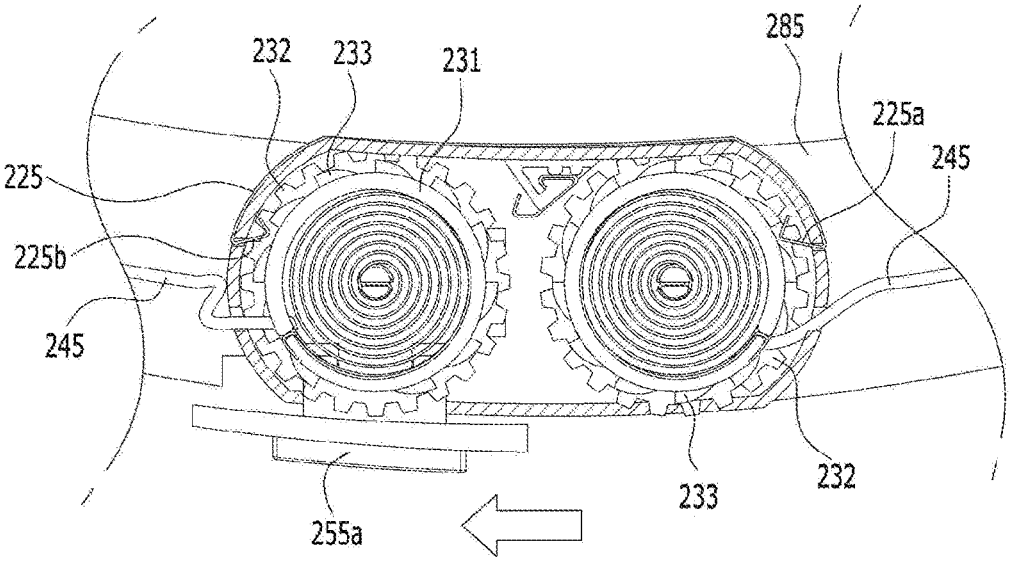
FIG. 16 is a diagram illustrating an exterior appearance of a slide button in a dual mode of wireless sound equipment in accordance with one embodiment of the present disclosure.

FIG. 16 is a diagram illustrating an exterior appearance of a slide button in a dual mode of wireless sound equipment in accordance with one embodiment of the present disclosure. As shown in FIG. 16, at least one of the winding devices 230 may move to be spaced apart from each other. Before the winding devices 230 move to be spaced apart from each other, the gears 232 of the winding devices 230 engaging with each other are also spaced apart from each other, only to separate the winding devices 230 from each other.

As the gears engaging with each other are spaced apart from each other, one winding device 230 rotates and the other winding device 230 is not affected by the rotation. Accordingly, only the winding device 230 of which the audio cable 245 is pulled is rotated. The mode which drives each of the winding devices 230 may be a single mode and the mode which drives the winding devices simultaneously may be a dual mode.

In this embodiment, one winding device 230 may move. Alternatively, the two winding devices 230 may move simultaneously and spaced apart from each other. A slide button 255 may be further provided for the user to move one winding device 230 to be spaced apart from the other winding device 230.

Figure 17:
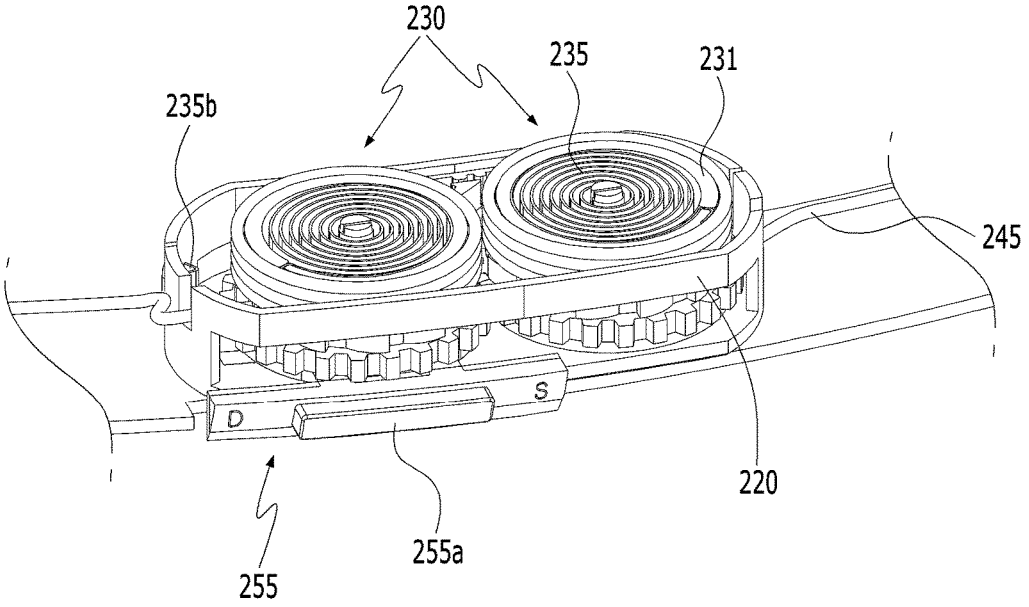
FIG. 17 is a diagram illustrating a slide button in a dual mode of wireless sound equipment in accordance with one embodiment of the present disclosure.

The slide button 255 shown in FIG. 17 is coupled to a base plate 236 of the moving winding device such that the base plate 236, the rotation housing 231 disposed on the base plate 236 and the helical spring 235 can move together.

Figure 18:
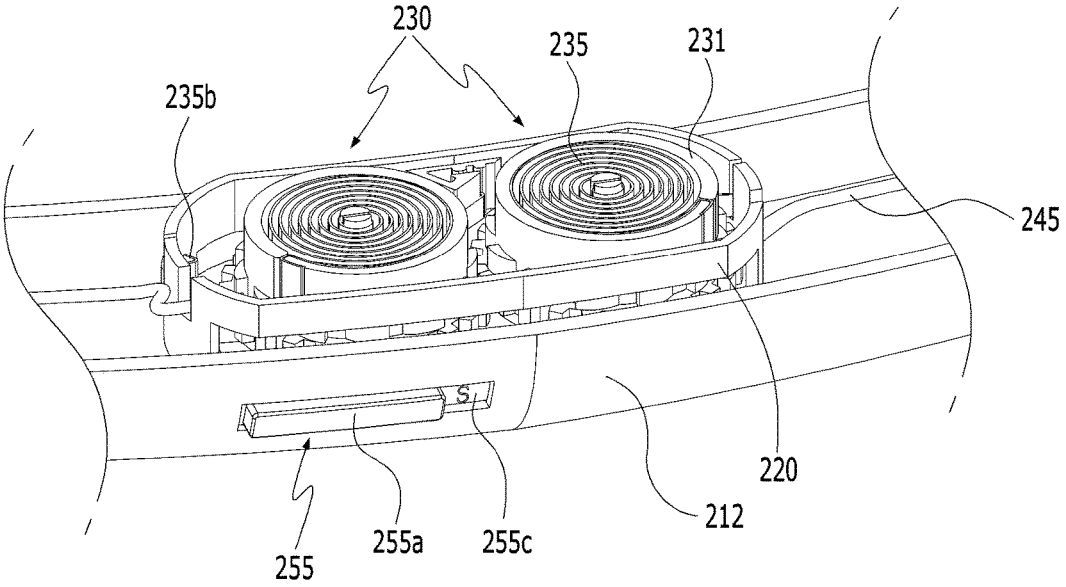
FIG. 18 is a diagram illustrating a slide button in a single mode of wireless sound equipment in accordance with one embodiment of the present disclosure.
Figure 19:
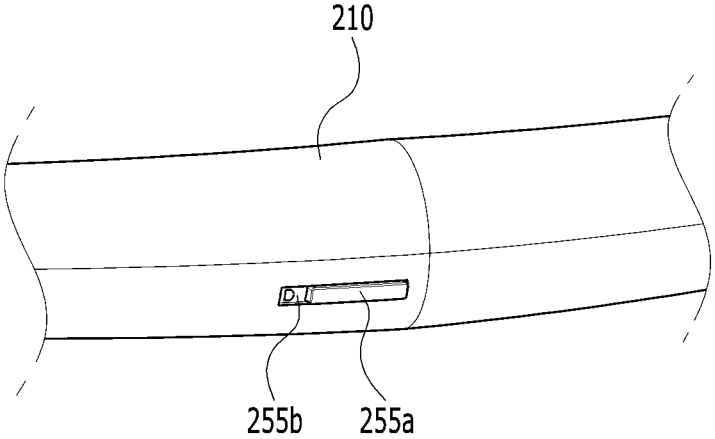
FIG. 19 is a plane view illustrating a slide button and a winding device in a single mode of wireless sound equipment in accordance with one embodiment of the present disclosure.

The slide button 17 shown in FIG. 17 may be exposed outside the case 210 to be pushed by the user. As shown in FIGS. 18 and 19, the slide button allows the user to recognize whether a current mode is a dual mode or a single mode, using characters and figures.

In other words, the slide button 255 is exposed outside via a window formed in the case of the case 210 and the slide button 255 exposed outside may be divided into a press portion 255*a* and display portions 255*b* and 255*c*. The user touches the pressure portion 255*a* to apply a force with a finger. "D" or "S" is displayed in the display portions 255*b* and 255*c* for the user to recognize whether the current state is the single mode or the dual mode. The pressure portion 255*a* is stepped with respect to the display portions 255*b* and 255*c*, only to restrict a moving range of the slide button 255.

Figure 20:
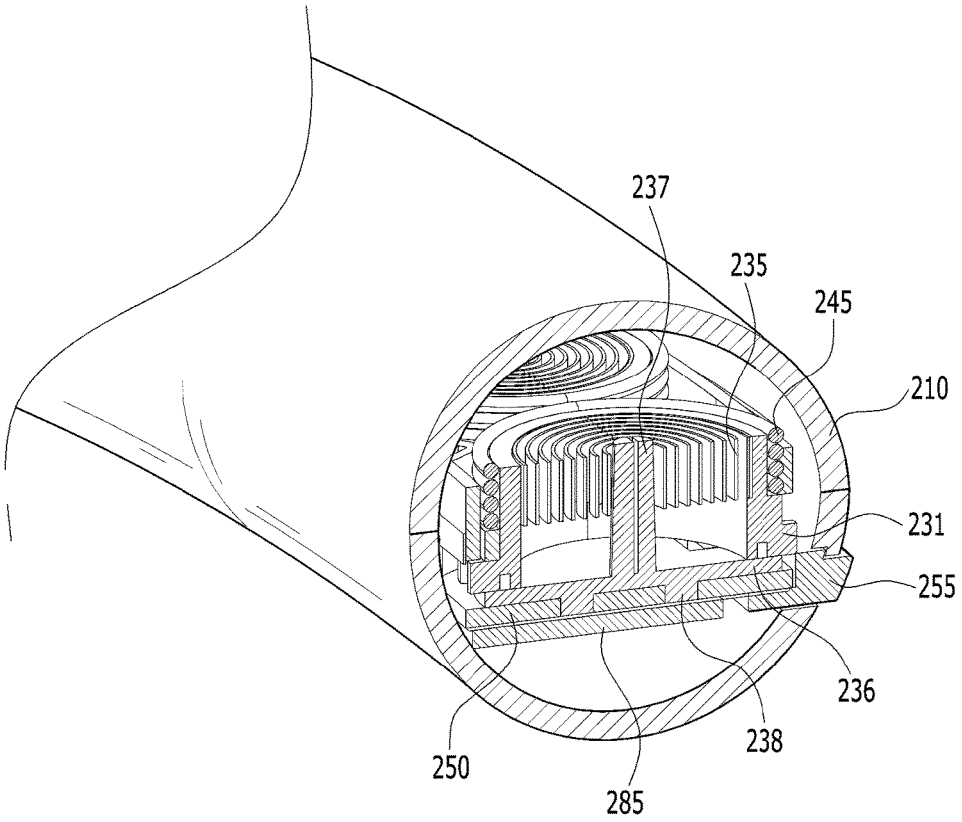
FIG. 20 is a sectional diagram of a winding device of wireless sound equipment in accordance with one embodiment of the present disclosure.
Figure 21:
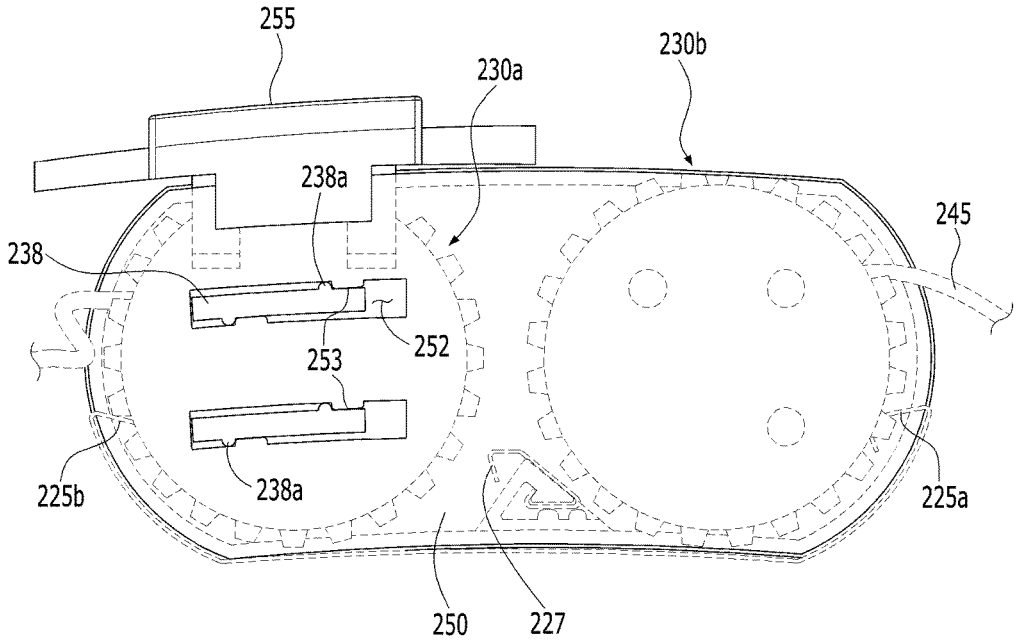
FIGS. 21 through 23 are base drawings illustrating a horizontal motion unit of wireless sound equipment in accordance with one embodiment of the present disclosure.
Figure 22:
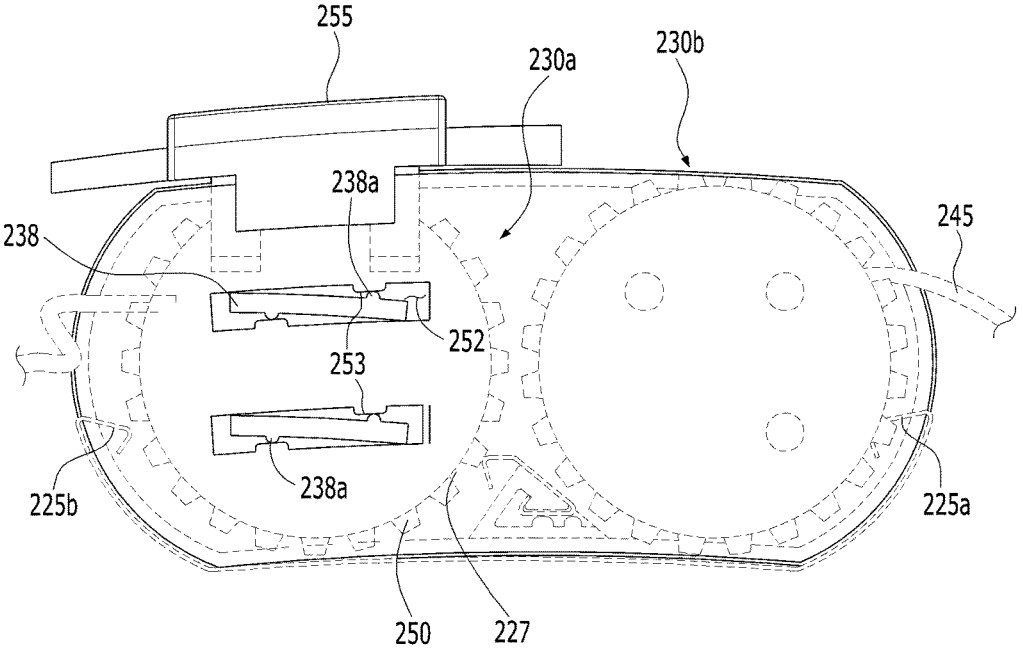
Figure 23:
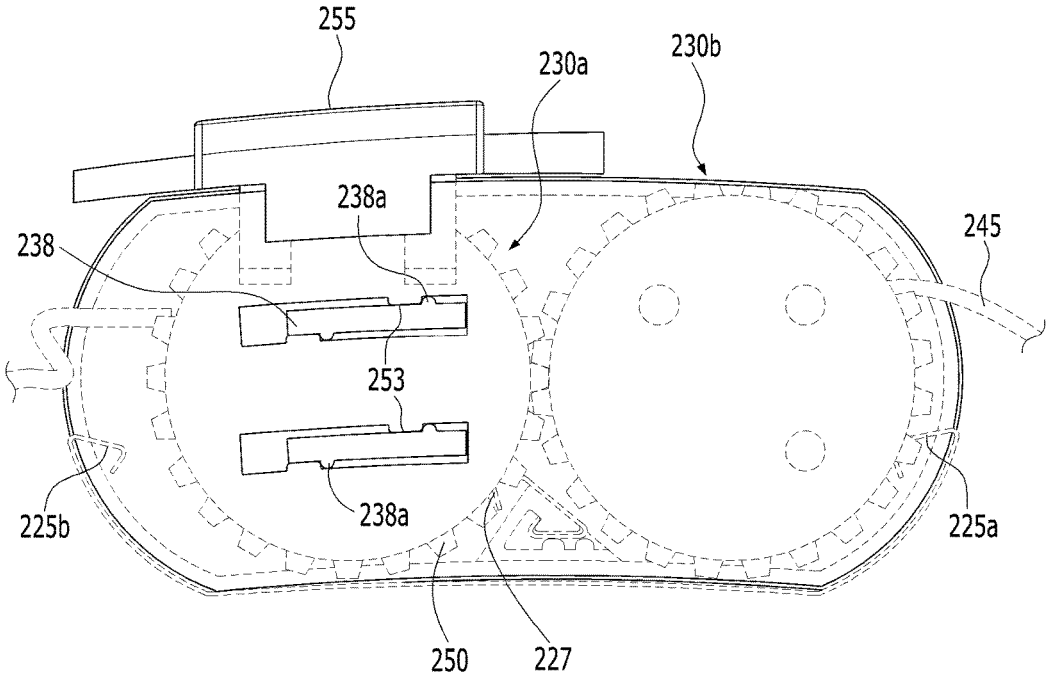

FIG. 20 is a sectional diagram of a winding device 230 of wireless sound equipment 200 in accordance with one embodiment of the present disclosure. FIGS. 21 through 23 are base drawings illustrating a horizontal motion unit of wireless sound equipment 200 in accordance with one embodiment of the present disclosure;

At least one of the winding devices 230 may adjust a distance between the winding devices 230, using the horizontal moving unit. For explanation convenience sake, one winding device movable in a right and left direction may be a first winding device 230*a* and the other fixed winding device may be a second winding device 230*b*. The pair of the winding devices 230*a* and 230*b* may move in a right and left direction simultaneously. The horizontal moving unit may include a slide bar 238 and a slide slit 252.

The slide bar 238 is projected from a bottom surface of the base plate 236 provided in the first winding device 230*a*. The slide slit 252 is formed in a corresponding position of a button portion 250, where the winding device 230 is disposed, to the slide bar 238. Compared with the slide bar 238, the slide slit 252 may be extended more in a longitudinal direction. The slide slit 252 and the slide bar 238 may be curved, corresponding to the shape of the case 210.

As the slide bar 238 is moved in a longitudinal direction of the slide slit 252, the mode is converted into the dual mode or the single mode. At this time, unless the user changes a mode state, using the slide button 255, after the slide bar 238 is moved to the dual mode or the single mode along the slide slit 252, it is necessary to keep the mode state. To fix the moved state, fixing projections 238*a* and 253 may be further provided in the slide bar 238 and the slide slit 252, respectively.

A first fixing projection 253 formed in the slide slit 252 and a second fixing projection 238*a* formed in the slide bar 238 are located in a lateral direction in parallel (overlapped in a longitudinal direction) in the dual mode and the single mode. To convert the dual mode into the single mode, the second fixing projection 238*a* and the first fixing projection 253 have to pass a first stopping projection 253, in a state of overlapped in a thickness direction.

To convert the single mode shown in FIG. 21 into the dual mode shown in FIG. 23, the second fixing projection 238*a* is overlapped with the first fixing projection 253 in a direction of the thickness. Once the single mode is converted into the dual mode, the first fixing projection 253 and the second fixing projection 238*a* shown in FIG. 19 are arranged in a lateral direction in parallel. The first fixing projection 253 has a corresponding length to the distance where the winding device 230 is moved.

When moving along the horizontal moving unit, the location of the first winding device 230*a* is changed and the distance from the stopper 227 is increased. In other words, the first stopper 227 restricting the rotation of the winding device 230*a* in the dual mode cannot restrict the rotation of the first winding device 230*a* in the single mode. A second stopper 225*b* for restricting the rotation of the first winding device 230*a* in the single mode may be further provided.

A third stopper 225*a* for restricting the rotation of the second winding device 230*b* not moving may restrict the rotation of the second winding device 230*b* in both of the single and dual mode.

Figure 24:
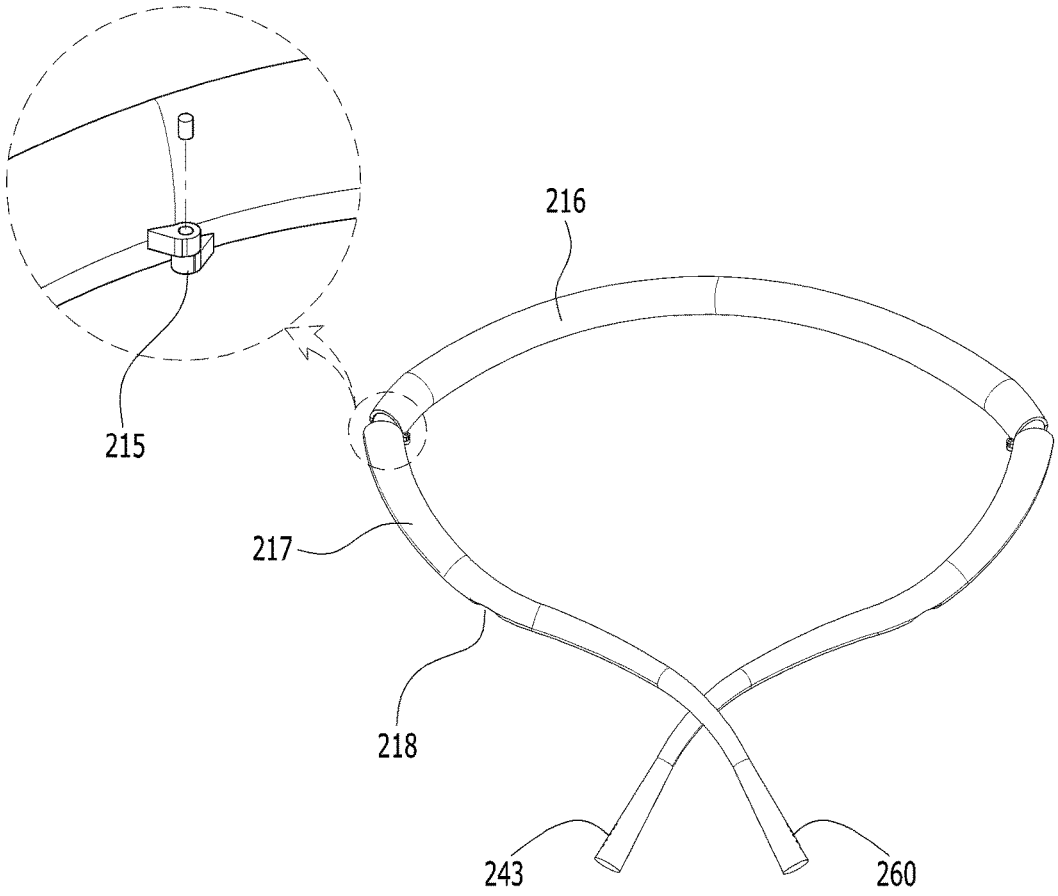
FIG. 24 is a diagram illustrating a hinge of wireless sound equipment in accordance with one embodiment of the present disclosure.

FIG. 24 is a diagram illustrating a hinge of wireless sound equipment in accordance with one embodiment of the present disclosure. The case 210 may include a first frame 216 provided in a center thereof and a pair of second frames 217 provided in both ends of the first frame 216, respectively. The first frame 216 and the second frame 217 may be bent and they may be foldable like glasses as shown in FIG. 20.

To bend the first frame 216 and the second frame 217, a hinge is provided between the first frame 216 and the second frame 217 to connect the frames with each other. The case 210 is folded to hand-carry by the rotation of the hinge 215.

Figure 25:
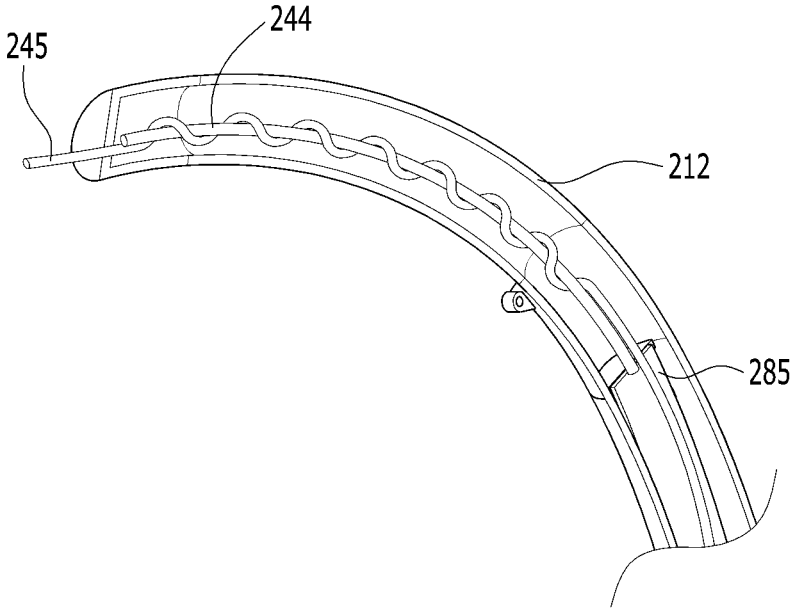
FIG. 25 is an exploded perspective diagram illustrating an audio cable kept in a case of wireless sound equipment in accordance with one embodiment of the present disclosure.

FIG. 25 is an exploded perspective diagram illustrating an audio cable 245 kept in a case of wireless sound equipment 200 in accordance with one embodiment of the present disclosure. A pole-shaped wire 244 may be provided in the case 210. As the audio cable 245 is wound around the wire 244, the audio cable 245 may be held in the case 210. Using the wire allows a longer audio cable 245 to be to be held in the case 210.

The wire 244 may be formed of bendable iron or silicon such that it can be transformed freely in accordance with the transformation of the case 210.

Figure 26:
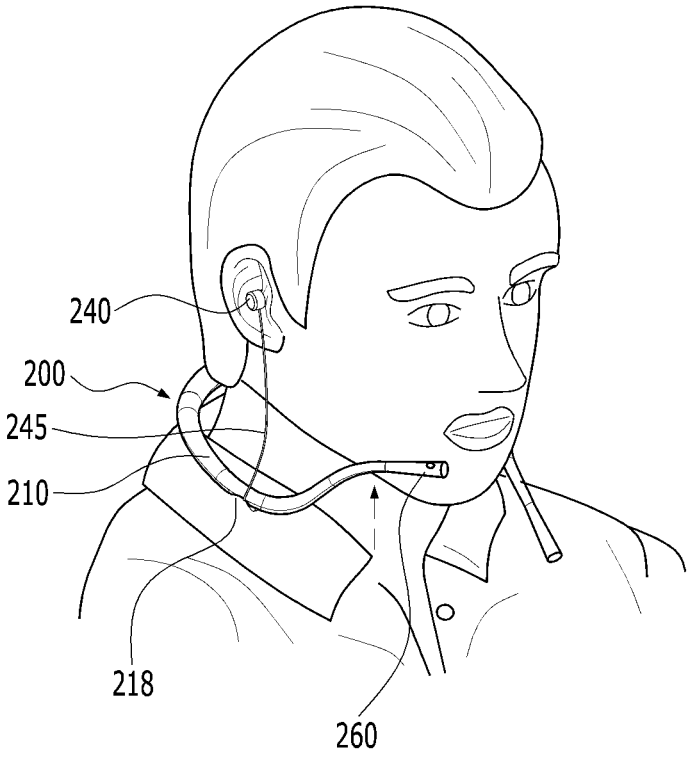
FIG. 26 is a diagram illustrating a usage state of wireless sound equipment in accordance with one embodiment of the present disclosure.

FIG. 26 is a diagram illustrating a usage state of wireless sound equipment in accordance with one embodiment of the present disclosure. When using the microphone 260, it is shown that the microphone 260 located in an end of the case 210 is used.

To overcome an inconvenient disadvantage that the user has to hold and locate the case 210 near the mouse on the phone, the case 210 may be formed of a flexible material as shown in FIG. 22 and then the case 210 is bent to transform the shape of the case 210.

The case 210 is fixed in a state of being transformed and the user re-unfolds the case 210 into the original shape. Alternatively, a hinge structure is applied to the case 210 and the microphone 260 is bendable to locate the microphone 260 near the user's mouse.

As mentioned above, the wireless sound equipment 200 may hold the receiver in the case 210 which is wearable on the user's neck and the audio cable connected to the receiver 240 is held in the case 210. Accordingly, a disadvantage of the encumbering audio cable 245 may be overcome.

When holding the receiver 240, only a predetermined portion of the receiver 240 is held and the other portion of the receiver 240 may be held in or decoupled from symmetrically with respect to the predetermined portion of the audio cable 245. Accordingly, user convenience may be enhanced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. Wireless sound equipment comprising:

a case forming an exterior appearance a first holder provided in one side of the case and a second holder provided in another of the case;

a first receiver and a second receiver coupled to and decoupled from the first holder and the second holder, respectively;

a first winding device rotatably mounted in the case, the first winding device comprising a first gear formed in an outer circumference;

a second winding device rotatably mounted in the case, the second winding device comprising a second gear formed in an outer circumference to engage with the first gear;

a first audio cable connecting the first receiver and the first winding device, and wound around the outer circumference of the first winding device;

a second audio cable connecting the second receiver and the second winding device, and wound around the outer circumference of the second winding device; and a horizontal motion unit comprising:

a slide slit fixed to the case and extended in one direction;

a slide bar projected from a lower surface of the first or second winding device and movable in a state of being inserted in the slide slit;

a first fixing projection formed in the slide slit; and a second fixing projection formed in the slide bar, wherein the first fixing projection and the second fixing projection are overlapped with each other in a thickness direction of the slide slit while the first or second winding device is moving, and wherein the first fixing projection and the second fixing projection are overlapped with each other in a longitudinal direction when the motion of the first or second winding device is completed.

2. The wireless sound equipment of claim 1, further comprising:

a stopping projection formed in an outer surface of at least one of the first and second winding devices, the stopping projection comprising a first inclined surface and a second inclined surface formed in asymmetry; and a stopper coupled to the stopping projection to restrict the rotation of the first and second winding devices.

3. The wireless sound equipment of claim 2, wherein the first inclined surface is gentle and the second inclined surface is steep, and the stopper comprises a flexible material transformed based on the first winding device and variation of the height of the first inclined surface in a rotational direction of the first winding device, and the stopper is coupled to the stopping projection to restrict the rotation of the first and second winding devices, when located on the second inclined surface.

4. The wireless sound equipment of claim 2, further comprising:

a restitution switch for decoupling the stopper from the stopping projection to allow the rotation of the first and second winding devices.

5. The wireless sound equipment of claim 1, wherein each of the first and second winding devices comprises:

a base plate coupled to the case;

a shaft projected from a top surface of the base plate;

a cylindrical rotation housing disposed on a top surface of the base plate;

and a helical spring comprising one end coupled to the shaft and the other end spirally wound around the shaft and coupled to the rotation housing, and wherein the helical spring of the first winding device and the helical spring of the second winding device are wound in a reverse direction.

6. The wireless sound equipment of claim 1, wherein the horizontal motion unit for adjusting a distance between the first and second winding devices by moving at least one of the first or second winding devices, wherein when the distance between the first and second winding devices is increased, the first gear and second gear engaging with each other is separated from each other.

7. The wireless sound equipment of claim 1, wherein a length of the first fixing projection corresponds to a moving distance of the horizontal motion unit.

8. The wireless sound equipment of claim 6, further comprising:

a slide button exposed outside the case to drive the horizontal motion unit.

9. The wireless sound equipment of claim 6, further comprising:

a stopping projection comprising a first inclined surface and a second inclined surface formed in outer surfaces of the first and second winding devices in asymmetry, respectively; and a stopper projected from an inside of the cover case and coupled to the stopping projection to restrict the rotation of the first and second winding devices, wherein the stopper comprises:

a first stopper coupled to at least one of the stopping projection of the first winding device and the stopping projection of the second winding device, in a state where the first gear and the second gear engage with each other; and a second stopper coupled to the stopping projection of the first winding device, in a state where the first gear and the second gear are separated from each other.

10. The wireless sound equipment of claim 9, wherein the stopper further comprises a leaf spring which is folded.

11. The wireless sound equipment of claim 9, wherein the stopper is projected from an inside of the cover case provided in each outer circumference of the first and second winding devices, and the cover case comprises:

a fixing case fixed to the case; and a moving case coupled to the stopper to relatively slide with respect to the fixing case and to adjust a distance between the stopper and the stopping projection.

12. The wireless sound equipment of claim 11, further comprising:

a restitution switch having a force applied by a user in a direction where the stopper is spaced apart from the stopping projection.

13. The wireless sound equipment of claim 11, further comprising:

a flexible material disposed between the moving case and the fixing case to restitute the moving case to an original position after the moving case slidingly moves.

14. The wireless sound equipment of claim 1, further comprising:

at least one of a speaker or a microphone coupled to the case.

15. The wireless sound equipment of claim 1, further comprising:

a wire mounted in the case, wherein the first audio cable and the second audio cable are wound around the wire.

16. The wireless sound equipment of claim 1, wherein the first holder and the second holder are shaped to be located under a user's ear when the case is worn on the user's neck.

17. The wireless sound equipment of claim 1, wherein:

the case comprises a first frame and a second frame; and the wireless sound equipment further comprises a hinge unit located between the first frame and the second frame such that the first frame and the second frame are rotatable to adjust an angle between the first frame and the second frame.

* * * * *